US008054982B2

(12) United States Patent
Yang et al.

(10) Patent No.: US 8,054,982 B2
(45) Date of Patent: Nov. 8, 2011

(54) SOUND SIGNAL GENERATOR TESTING APPARATUS

(75) Inventors: Tsung-Lung Yang, Guangdong (CN); Chin Poh Koh, Guangdong (CN); Shin-Hong Chung, Guangdong (CN); Shu-Ho Wu, Guangdong (CN); Kuan-Hong Hsieh, Guangdong (CN)

(73) Assignee: Hon Hai Precision Industry Co., Ltd., Tucheng Dist., New Taipei (TW)

( * ) Notice: Subject to any disclaimer, the term of this patent is extended or adjusted under 35 U.S.C. 154(b) by 1343 days.

(21) Appl. No.: 11/620,054

(22) Filed: Jan. 5, 2007

(65) Prior Publication Data

US 2007/0172072 A1 Jul. 26, 2007

(30) Foreign Application Priority Data

Jan. 21, 2006 (CN) ..... 2006 1 0033241

(51) Int. Cl.
*H04R 29/00* (2006.01)

(52) U.S. Cl. ..... 381/58; 381/94.1; 702/104

(58) Field of Classification Search ..... 381/58, 381/59, 122, 74.1, 94.1, 71.4, 71.1, 150, 381/71.8, 98; 228/124.6, 122.1; 702/104, 702/108, 124; 73/571, 570; 181/284, 146, 181/208

See application file for complete search history.

(56) References Cited

U.S. PATENT DOCUMENTS

| | | | | |
|---|---|---|---|---|
| 6,560,497 | B2 | 5/2003 | Naruki et al. | |
| 6,668,650 | B1 * | 12/2003 | Lafleur et al. | 73/571 |
| 6,775,385 | B1 * | 8/2004 | Coombs | 381/99 |
| 6,795,557 | B1 | 9/2004 | Mäkivirta | |
| 7,602,923 | B2 * | 10/2009 | Lee et al. | 381/59 |

OTHER PUBLICATIONS

Inventors: Gong-Huan Du, Zhe-min Zhu, Xiu-Fen Gong; Title of the Article: Fundamentals of Acoustics; Date of the issue of the Article: Mar. 2001; ISBN of the Article: 7-305-03631-5; p. 462; publisher: nan jing university publishing company; City wherein published: nan jin, Translation.

* cited by examiner

*Primary Examiner* — Vivian Chin
*Assistant Examiner* — Con P Tran
(74) *Attorney, Agent, or Firm* — Winston Hsu; Scott Margo

(57) ABSTRACT

A sound signal generator testing apparatus is provided. The apparatus includes a hermetic seal (2), a sound signal input unit (4), and at least a noise suppression unit (5). The sound signal input unit is for receiving sound signals transmitted from a sound signal generator (1) under testing. Each noise suppression unit includes a sound signal input unit, a low pass filter, an inverter, and an output. The sound signal input unit is for receiving sound signals. The low pass filter is for filtering the sound signals by passing the low frequencies of the sound signals that are below a predetermined value. The inverter is for inverting phases of the sound signals transmitted from the low pass filter and producing inverted sound signals. The output unit is placed behind the sound signal input unit for outputting the inverted sound signals.

7 Claims, 3 Drawing Sheets

SOUND SIGNAL GENERATOR TESTING APPARATUS

BACKGROUND OF THE INVENTION

1. Field of the Invention

The present invention relates generally to a sound signal generator testing apparatus, and particularly to a sound signal generator testing apparatus for preventing reflected sound signals to affect a testing result.

2. Description of Related Art

After manufactured, sound signal generators such as speakers, are tested to ensure that sound parameters meets predetermined values. During the test, the sound signal generators are placed inside of a testing apparatus. The testing apparatus is a hermetically sealed enclosure. Sound signals generated by the sound signal generators are reflected back by the inner wall of the hermetically sealed enclosure. Those reflected sound signals become noises relative to the sound signals, and affect the testing result.

Generally, acoustical absorbent is used to cover the inner wall of the hermetically sealed enclosure to suppress the reflected sound signals. In the hermetically sealed enclosure, the high frequency sound signals and the medium frequency sound signals can be easily absorbed by the acoustical absorbent in a relative small size of the hermetically sealed enclosure. However, the low frequency sound signals are difficult to absorb. In order to absorb the low frequency sound signals, the size of the hermetically sealed enclosure must be increased.

What is needed is a sound signal testing apparatus that can suppress low frequencies of reflected sound signals (echoes) of sound signals from sound signal generators, without increasing size of the sound signal testing apparatus.

SUMMARY

A sound signal generator testing apparatus is provided. A preferred embodiment of the sound signal generator testing apparatus includes a hermetically sealed enclosure, a sound receiving unit, and at least a noise suppression unit. The sound receiving unit is disposed inside the hermetically sealed enclosure and connects to a testing unit, for receiving sound signals transmitted from a sound signal generator being tested. The noise suppression units are provided to suppress noises (echoes of the sound signals bouncing of walls of the hermetically sealed enclosure). Each noise suppression unit includes a sound signal input unit, a low pass filter, an inverter, and an output. The sound signal input unit is for receiving the sound signals. The low pass filter is for filtering the sound signals transmitted from the sound signal input unit and passes low frequencies of the sound signals that are under a predetermined value, thereby yielding filtered sound signals. The inverter is for inverting phases of the filtered sound signals transmitted from the low pass filter and producing inverted sound signals. The output unit is placed behind the sound signal input unit and is used for outputting the inverted sound signals.

Other advantages and novel features will be drawn from the following detailed description of the preferred embodiment with reference to the attached drawings, in which:

DETAILED DESCRIPTION OF THE INVENTION

Figure 1:
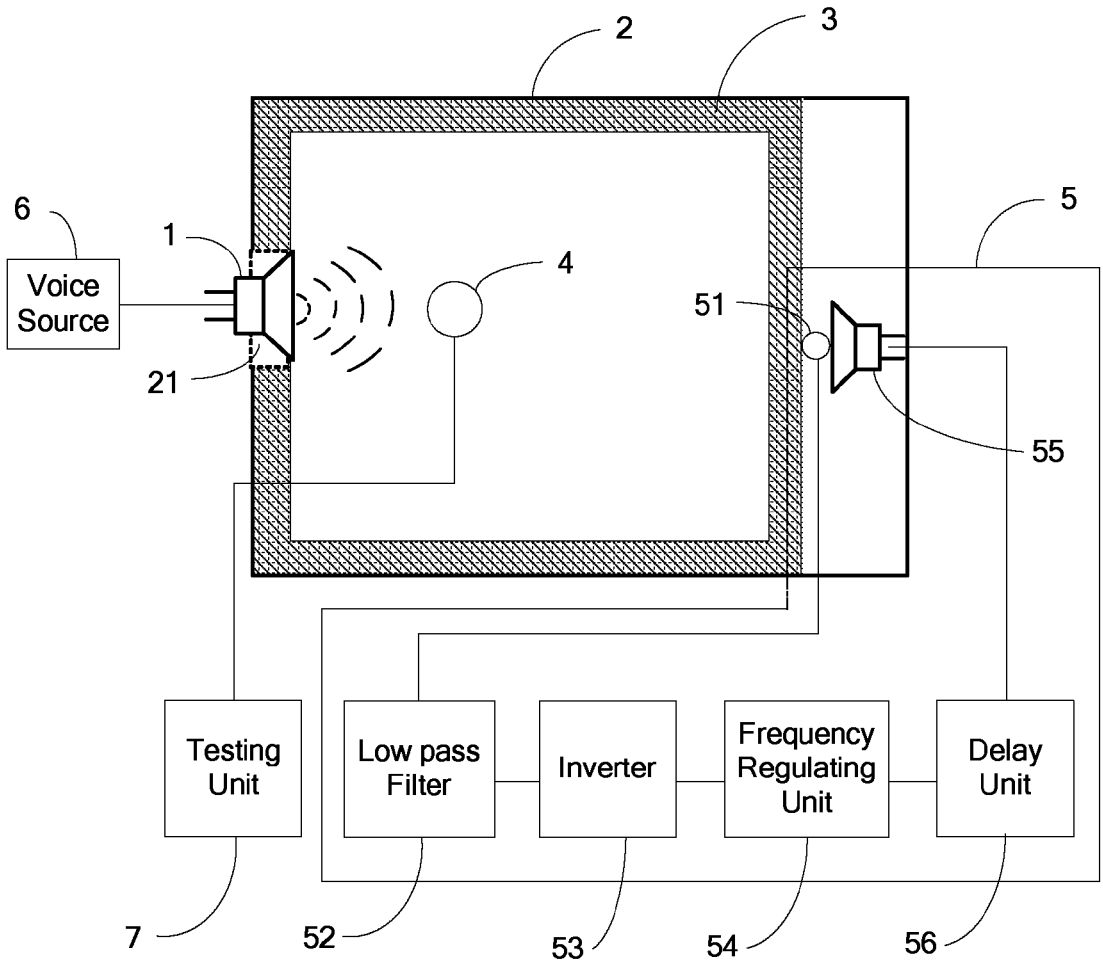
FIG. 1 is an operation principle schematic diagram of a sound signal testing apparatus of a first preferred embodiment.

FIG. 1 is an operation principle schematic diagram of a sound signal testing apparatus of a first preferred embodiment. The sound signals testing apparatus (hereafter "the apparatus") includes a hermetically sealed enclosure 2, an acoustical absorbent 3, a sound signal input unit 4, a testing unit 7, and at least a noise suppression unit 5. The acoustical absorbent 3 is disposed inside the hermetically sealed enclosure 2 and covers inner walls of the hermetically sealed enclosure 2. The acoustical absorbent 3 absorbs high frequency sound signals and medium frequency sound signals. However, as mentioned in the foregoing, it is difficult for the acoustical absorbent 3 to absorb low frequency sound signals if the hermetically sealed enclosure 2 has a relative small size. A through hole 21 is defined through a wall of the hermetically sealed enclosure 2 and the acoustical absorbent 3, and holds a sound signal generator 1 undergoing a test. The sound signal generator 1 tightly seals the hole 21 and connects with a sound source 6. The sound source 6 transmits sound signals in a predetermined frequency range to the sound signal generator 1. In this preferred embodiment, the sound signal generator 2 is a speaker 1 that outputs the sound signals, thus, the sound signals are broadcasted within the hermetically sealed enclosure 2. The sound signal input unit 4 is for receiving the sound signals transmitted from the sound signal generator 1, the sound signal input unit 4 is disposed inside the hermetically sealed enclosure 2 and is connected to the testing unit 7. In this preferred embodiment, the sound receiving unit 4 is a microphone. The testing unit 7 is for performing the test with testing parameters, such as frequencies and amplitudes of the sound signals received by the sound signal input unit 4, the test reflects the performance of the sound signal generator 1.

at least one noise suppression unit 5 is provided to suppress noises. That is, the noise suppression units 5 suppresses reflected sound signals (echoes/noises) transmitted to the sound signal testing apparatus 15 from the inner walls, thus suppressing the reflected sound signals. The noise suppression unit 5 generates inverted sound signals that have same frequencies but inverted phases relative to the sound signals transmitted by the sound signal generator 1. The at least one noise suppression units 5 may be located at different positions of the inner walls of the hermetically sealed enclosure 2, so as to suppress the reflected sound signals from different directions. In this and other preferred embodiments, one noise suppression unit 5 is taken as an example to illustrate hereinafter.

The noise suppression unit 5 includes a sound signal input unit 51, a low pass filter 52, an inverter 53, a frequency regulating unit 54, an output unit 55, and a delay unit 56. The sound signal input unit 51 locates behind the acoustical absorbent 3 and is used for receiving the sound signals that passes through the acoustical absorbent 3. In the preferred embodiment, for the acoustical absorbent 3 absorbs the high and medium frequencies of the sound signals, the sound signal input unit 51 mainly receives a low frequency of the sound signals, and the sound signal input unit 51 may be a microphone.

The sound signals are transmitted by the sound signal input unit 51 to the low pass filter 52. The low pass filter 52 filters the sound signals by passing the low frequencies of the sound signals that are below a predetermined value, thereby yielding filtered sound signals. The filtered sound signals are then transmitted to the inverter 53 to invert a polarity of the filtered sound signals, thereby yielding the inverted sound signals. Subsequently, the inverted sound signals are transmitted to the frequency regulating unit 54.

Generally, the output unit 55 is placed behind the sound signal input unit 51 at a distance. The frequencies of the sound signals are attenuated when the sound signals is transmitted from the sound signal obtaining unit 51 to the output unit 55. The attenuation can be calculated according to the distance between the output unit 55 and the sound signal input unit 51, thereby determining a frequency attenuation coefficient of the sound signals.

The frequency regulating unit 54 regulates the frequencies of the inverted sound signals from the inverter 53 according to the frequency attenuation coefficient so that the inverted sound signals has a same frequency as the sound signals. The frequency regulating unit 54 transmits the inverted sound signals to the delay unit 56. The delay unit 56 delays the inverted sound signals for a predetermined delay time before transmitting the inverted sound signals to the output unit 55 so that the inverted sound signals are outputted from the output unit 55 at a same phase with the reflected sound signals. The predetermined delay time is obtained from the distance between the sound signal input unit 51 and the output unit 55. For Example, supposing the distance between the sound signal input unit 51 and the output unit 55 is almost zero, the frequency attenuation coefficient inputted to the frequency regulating unit 54 is "1" and the delay time for the delay unit is "0". The inverted sound signals are transmitted to the output unit 55 by the delay unit 54 after the delay time, and the output unit 55 outputs the inverted sound signals to suppress the reflected sound signals.

Figure 2:
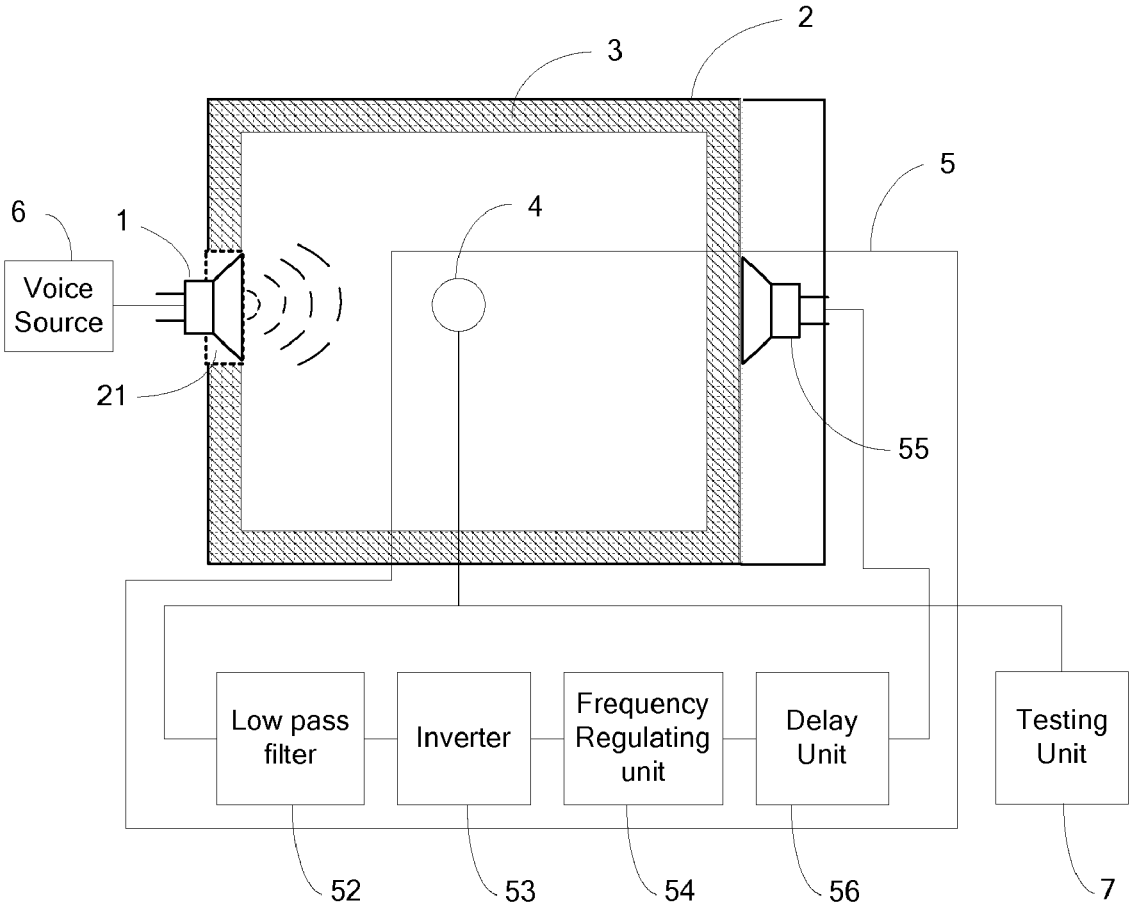
FIG. 2 is an operation principle schematic diagram of a sound signals testing apparatus of a second preferred embodiment; and, FIG. 3 is an operation principle schematic diagram of a sound signals testing apparatus of a third preferred embodiment.

FIG. 2 is an operation principle schematic diagram of a sound signal testing apparatus of a second preferred embodiment. Compared with the first preferred embodiment, in this embodiment, the sound signal input unit 4 connects to the low pass filter 52 as well as to the testing unit 7. The sound signal input unit 4 is employed instead of the sound signal input unit 51 in the first embodiment to transmit the sound signals to the low pass filter 52. A distance between the sound signal input unit 4 and the output unit 55 is obtained to determine the frequency attenuation coefficient for the frequency regulating unit 54 and the delay time for the delay unit 56.

Figure 3:
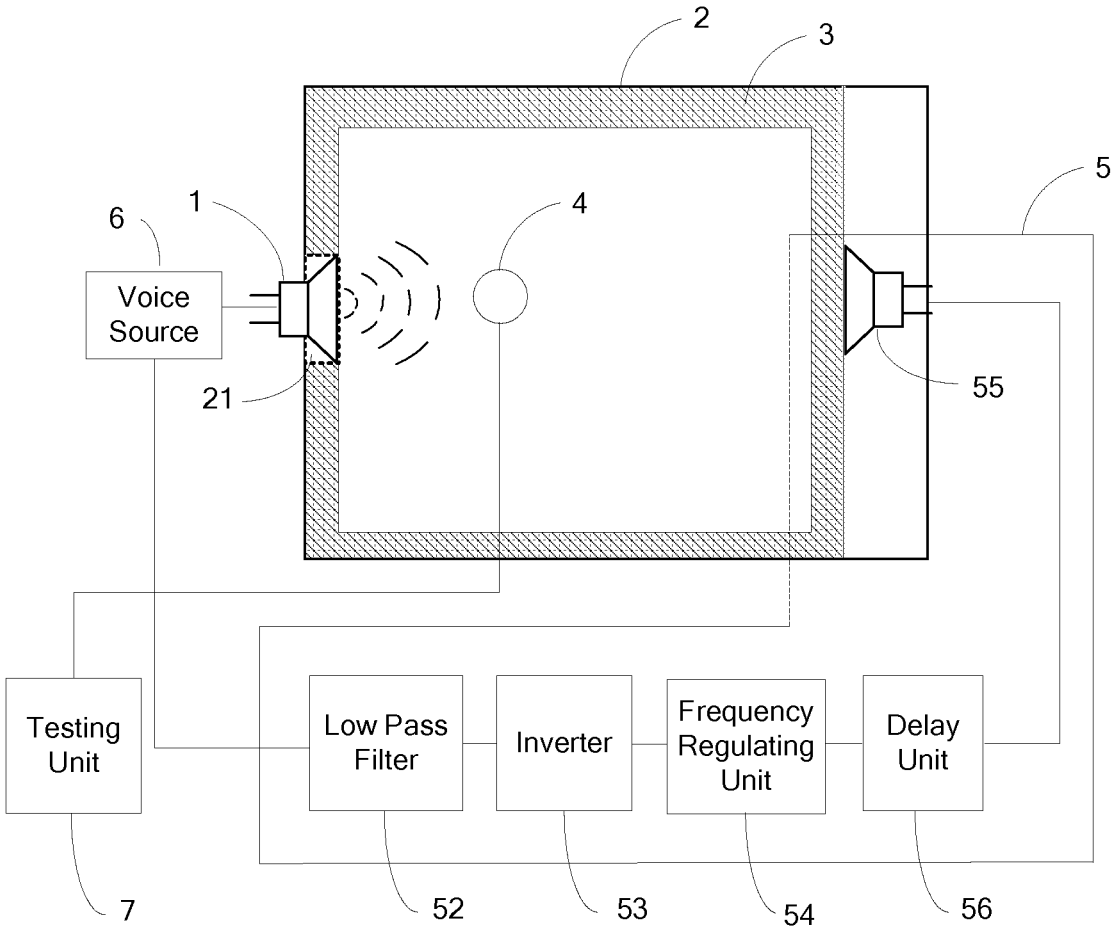

FIG. 3 is an operation principle schematic diagram of a sound signal testing apparatus of a third preferred embodiment. Compared with the first preferred embodiment, in this embodiment the low pass filter 52 connects to the sound source 6 and receives the sound signals from the sound source 6. The sound source 6 is employed instead of the sound signal input unit 51 in the first embodiment to transmit the sound signals to the low pass filter 52. A distance between the sound signal generator 1 and the output unit 55 is obtained to determine the frequency attenuation coefficient for the frequency regulating unit 54 and the delay time for the delay unit 56.

Although the present invention has been specifically described on the basis of a preferred embodiment, the invention is not to be construed as being limited thereto. Various changes or modifications may be made to the embodiment without departing from the scope and spirit of the invention.

What is claimed is:

1. A sound signal generator testing apparatus, comprising:

a hermetically sealed enclosure;

an acoustical absorbent;

a first sound signal input unit disposed inside of the hermetically sealed enclosure and inside the acoustical absorbent and connected to a testing unit, for receiving sound signals transmitted from a sound signal generator under testing; and at least a noise suppression unit, comprising:

a second sound signal input unit for receiving sound signals, the second sound signal input unit being disposed outside of the acoustical absorbent;

a low pass filter filtering the sound signals by passing the low frequencies of the sound signals that are below a predetermined value;

an inverter for inverting a polarity of the filtered sound signals;

an output unit being placed behind the second sound signal input unit for outputting the inverted sound signals, the output unit being disposed outside of the acoustical absorbent.

2. The sound signal testing apparatus as described in claim 1, wherein both of the first sound signal input unit and the second sound signal input unit are microphones.

3. The sound signal testing apparatus as described in claim 1, further comprising a frequency regulating unit interposed between the inverter and the output unit, for regulating frequencies of the inverted sound signals.

4. The sound signal testing apparatus as described in claim 3, further comprising a delay unit interposed between the frequency regulating unit and the output unit, for delaying the inverted sound signals for a predetermined delay time before transmitting the inverted sound signals to the output unit.

5. The sound signal testing apparatus as described in claim 4, wherein the low pass filter connects to the first sound signal input unit for receiving the sound signals received by the first sound signal input unit.

6. The sound signal testing apparatus as described in claim 4, wherein the low pass filter connects to a sound source for receiving the sound signals, the sound signal source being used to providing sound signals to the sound signal generator.

7. The sound signal testing apparatus as described in claim 4, wherein the hermetically sealed enclosure comprises a through hole that is defined through a wall of the hermetically sealed enclosure, and holds the sound signal generator therein.

* * * * *